US005606808A

United States Patent [19]

Gilliard et al.

[11] Patent Number: 5,606,808

[45] Date of Patent: Mar. 4, 1997

[54] ADJUSTABLY STIFFENABLE SNOWBOARD BOOT

[76] Inventors: James F. Gilliard; Ryan F. Gilliard, both of HC 02, Box 139 B3, Harrison, Id. 83833-9609

[21] Appl. No.: 411,952

[22] Filed: Mar. 28, 1995

[51] Int. Cl.[6] ..... A43B 7/20; A43B 5/04

[52] U.S. Cl. ..... 36/89; 36/45; 36/57; 36/100; 36/115

[58] Field of Search ..... 36/45, 57, 88, 36/89, 100, 114, 115, 136

[56] References Cited

U.S. PATENT DOCUMENTS

| | | | |
|---|---|---|---|
| 194,361 | 8/1877 | McGuigan . | |
| 438,466 | 10/1890 | Booz . | |
| 522,371 | 7/1894 | Horn et al. | 36/89 |
| 641,689 | 1/1900 | Garrod . | |
| 643,783 | 2/1900 | Traylor . | |
| 737,959 | 9/1903 | Posner | 36/89 |
| 1,548,172 | 8/1925 | Redden | 36/89 |
| 2,211,822 | 8/1940 | Jennings | 36/89 X |
| 2,742,715 | 4/1956 | Meltzer | 36/2.5 |
| 4,766,612 | 8/1988 | Patton, Sr. | 2/161 |
| 5,113,526 | 5/1992 | Wang et al. | 2/161 |

FOREIGN PATENT DOCUMENTS

| | | | |
|---|---|---|---|
| 494979 | 8/1953 | Canada | 36/89 |
| 1193946 | 11/1959 | France | 36/89 |
| 0662483 | 10/1987 | Switzerland | 36/89 |

*Primary Examiner*—Marie D. Patterson
*Attorney, Agent, or Firm*—Keith S. Bergman

[57] ABSTRACT

A snowboarding boot having a flexible upper portion has one or more somewhat vertical elongate pockets on the surface of the upper portion to receive therein elongate, semi-rigid stiffening stays. Each pocket is formed of flexible material to define a medial channel having an open top and cross-sectional area similar to that of the stiffening stay to be carried therein to allow variable vertical positioning and positional maintenance of the stiffening stays by reason of frictional engagement with the pocket. Stiffening stays are formed of elongate strips of semi-rigid material, normally having some resiliency but being more rigid than the flexible upper portion of a boot, and the stiffening stays optionally carry a loop of flexible material in their upper end portions to aid insertion and removal and releasable fasteners for positional maintenance within a carrying pocket. The pockets extend downwardly from the top of a boot or to the ankle area in vertical or angulated orientation.

1 Claim, 3 Drawing Sheets

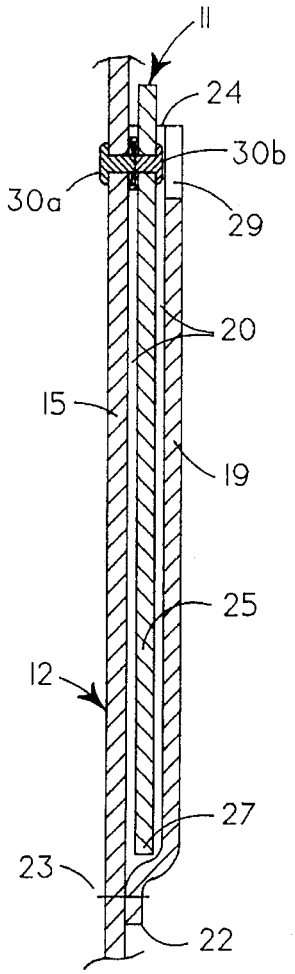
FIG. 6
FIG. 5
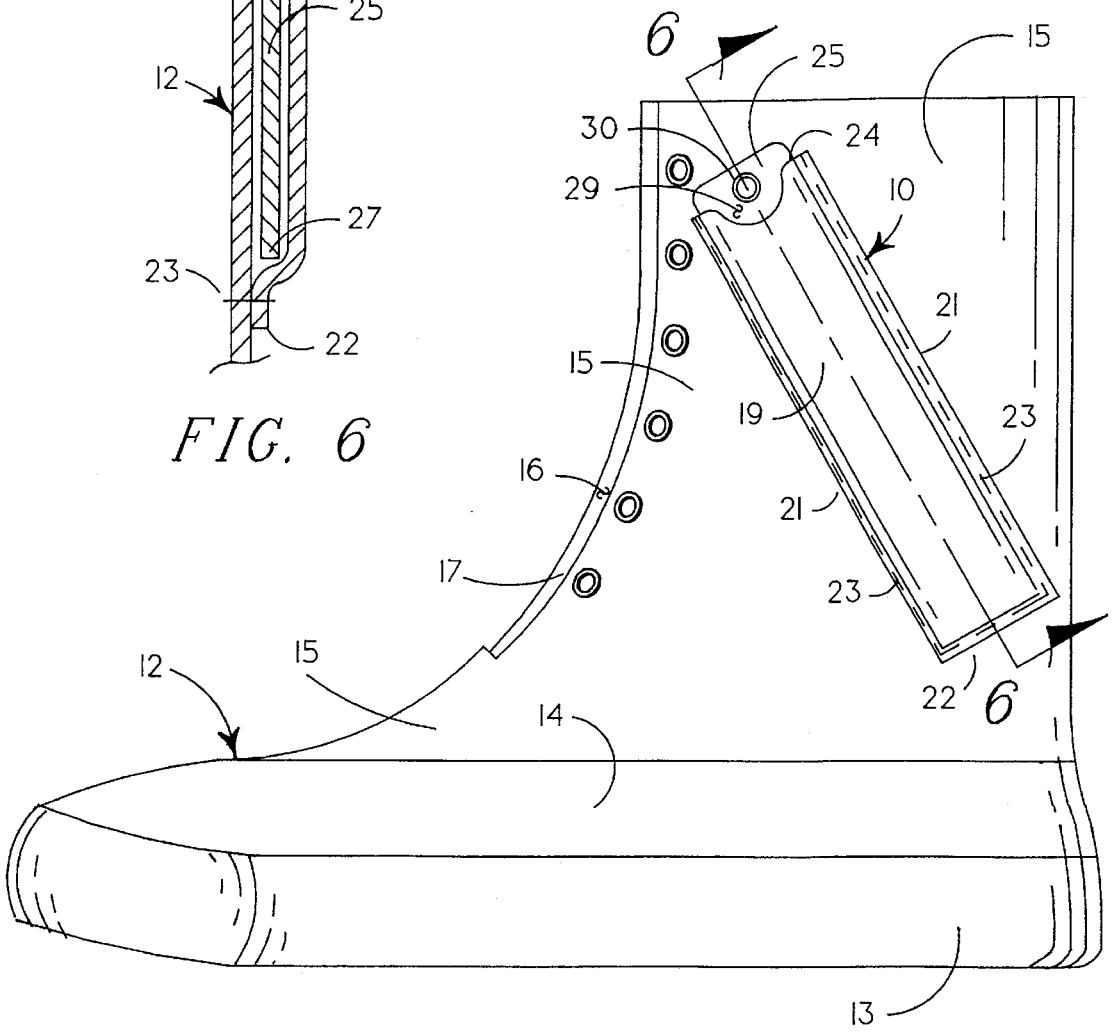

ADJUSTABLY STIFFENABLE SNOWBOARD BOOT

BACKGROUND OF INVENTION

1. Related Applications

There are no applications related hereto heretofore filed in this or any foreign country.

2. Field of the Invention

This invention relates generally to athletic boots, and more particularly to boots for snowboarding that have flexible uppers that are adjustably stiffenable by selectively positionable stays.

BACKGROUND AND DESCRIPTION OF PRIOR ART

Snowboarding is a winter sport of historically recent origin that has experienced rapid growth, both in popularity and number of participants. A participant in the sport, positions himself in a lateral orientation on a single snowboard that is somewhat shorter and substantially wider than a traditional snow ski. The snowboard is steered and controlled by the user's shifting of weight to cause varying forces on different parts of the board during its motion over a snow covered surface. Traditionally a snowboarder wears boots for comfort, support and protection of the feet and lower legs and those boots are normally positionally maintained, to at least some degree, on the snowboard by means of various boot harnesses.

It has been found in some snowboard activities which require little fine or rapid maneuvering, such as downhill racing and the like, that rigid boots which allow little or no motion of the upper portions of the boot in a lateral direction with reference to a snowboarder's ankle are of most comfort and utility. In the case of snowboard activities that do require fine and rapid maneuvering, such as in slalom snowboarding, the opposite is true, owever, and it has been found that boots having flexible uppers above the boot foot that allow lateral motion of the lower leg above the ankle are much more comfortable and utilitarian for this purpose. Responsively both rigid and flexible boots have become known individually for use by snowboarders for the particular activities which they best suit.

The instant invention seeks to provide a new and novel snowboarding boot that may be selectively changed from an upper portion having the complete flexibility of the boot upper through various intermediate states having varying rigidity to an upper having the substantial rigidity of any of the present day rigid boots. To accomplish this end, I provide a boot with one or more elongate vertically or vertically angulated oriented pockets on its upper portion to carry stiffening stays which may be inserted to selective lengths in the pockets to create adjustable rigidity in the upper portion of the boot.

It has heretofore become known to use devices of various sorts with both hand and foot wear that coincidentally stiffen that wear, but the purpose of such devices has been other than that of adjustable stiffening and by reason of this difference in purpose those prior devices are distinguished because of the particular structures they disclose that are specifically related to the purposes for which they were created. These prior devices also have in common the lack of any adjustable stiffening function per se.

Various rigid or semi-rigid elements have become known as additives to handwear, footwear and other clothing to provide protection to the wearer during hazardous activities such as to prevent cutting by saw blades, impact damage by moving or falling objects, injury from entanglement in machinery and the like. The nature of the materials which are used for this purpose normally tends to provide some additional rigidity for the article of clothing supporting the protective elements, but in general this art provides protectors of small size and compound articulating or flexible nature, such as coiled springs, to provide as much flexibility as possible. This art does not seek to provide stiffening at all and in fact, teaches away from it in attempting to provide flexibility. This art also, since it is not concerned with stiffening, does not show methods or means for adjustably regulating stiffening associated with some type of clothing in distinguishment from the instant stiffeners which are specifically created to provide adjustability.

The stiffening of various portions of footwear, and especially boots and higher top shoes, has also become known for purposes other than safety of the wearer. Most commonly, such stiffening has been for the purpose of preserving the original footwear shape and configuration to maintain the aesthetics of the footwear, to preserve its utility or to provide for proper foot support and comfort of a user. Various such supports have been associated with the upper portions of higher top boots to prevent those upper portions from moving downwardly during storage or while being worn. Such devices have usually provided elongate, vertically oriented stays that may be supported variously by the boot sole, by a heel vamp or by the boot uppers themselves by some type of mechanical fastening. Other such devices have commonly been associated with either the toe or the heel of a shoe or boot to maintain the configuration of these shoe elements, especially against forces caused by normal use of the shoe which tend to change or modify the original configuration of these elements. These various devices, however, all teach of providing sufficient rigidity to perform their function of maintaining particular footwear configuration and because of this, they necessarily provide some substantial rigidity to accomplish their purposes. Since such devices are not concerned with and teach away from providing flexibility, they also do not provide means for adjustment of their rigidity in distinguishment from the instant stiffeners which purposefully and directly teach of providing adjustable rigidity in the upper part of higher top footwear above the ankle area.

Ski and snowboarding boots in their inception generally were of a flexible nature, but as either sport increased in sophistication, various rigid or semi-rigid boots have become known. Various of this type of more rigid boot have been of a compound nature formed of a plurality of articulatingly joined elements that allow motion of various parts of the boot relative to the other parts. This structure has to some degree provided a boot that may have some of the functions of both a rigid and a flexible type of boot. It has also become known to provide connectors in the articulated portions of such boots that allow adjustment of the stiffness of the motion of particular joints to provide some degree of adjustability of the flexibility of such a boot. Such boots, however, have generally had relatively few articulated parts, and often only one articulated joint between the body and upper portion of the boot, so that in essence they tend to allow only a generally forward-rearward bending action of an ankle.

The instant boot is distinguished from such boots having rigid compound articulatingly interconnected elements by reason of its greater range of flexibility and the location of areas of restraint. The instant boot allows motion of the boot upper that is substantially as flexible as the boot material itself when the stiffening stays are completely removed from the boot. It also provides increasing rigidity starting at the upper part of the upper portion of the boot and extending progressively downwardly to the level of the ankle, but does not cause rigidity in the area at the ankle itself, to allow normal ankle motion that may not be accomplished with a boot having a rigid element extending about the ankle. This stiffening structure allows substantially greater control of a snowboard by a user than is had with the compound boot having articulatingly interconnected rigid elements. The instant boot at the same time, however, allows use of a rigid sole and body structure to provide the benefits of those elements while yet allowing the adjustably variable stiffness of the upper boot portion.

Our invention resides not in any one of these features individually, but rather in the synergistic combination of all of its structures that necessarily give rise to the functions flowing therefrom.

SUMMARY OF INVENTION

Our invention provides a snowboarding boot having a sole and body of ordinary construction, with an interconnected, flexible upper portion that may be adjustably stiffened from its top to the ankle level of a wearer.

The flexible upper portion of the boot provides plural elongate pockets carried on the inner or outer surfaces of the lateral portions of a boot upper portion. The pockets are elongate and extend from the top of the upper portion of the boot downwardly to the ankle level to define an internal channel in which stiffening stays are slidably carried. One or more of such pockets are defined on one or both of the outer lateral sides of a boot upper. A stiffening stay formed of rigid or semi-rigid, resiliently deformable material is provided for each pocket and is of a configuration to be frictionally carried within the channel defined by each pocket and extend through the vertical length of the pocket. The stiffening stays optionally may have an insertion, and fasteners to releasably positionally maintain the stay within a pocket.

In providing such an article, it is:

A principal object to create a snowboarding boot with sole and body of traditional design and function, but with a flexible upper portion that may be adjustably stiffened by selectively positionable stiffening stays.

A further object is to provide such a boot that has an upper portion supporting at least one somewhat vertically oriented, open top pocket on at least one of its lateral sides to carry a stiffening stay somewhat limit lateral motion of a wearer's lower leg above the ankle but allow motion of the ankle joint especially in a medial plane.

A still further object is to provide stiffening stays, having more rigid nature than the material of the boot upper portion, that may be inserted within the pockets defined on the boot upper portion and maintained in selective, vertical positions within those pockets by reason of frictional engagement therewith to allow adjustable stiffening of the boot upper portion.

A still further object is to provide such stiffening structure that may be installed during boot manufacture or added to existing boots after their manufacture.

A still further object is to provide such an article and stiffening structure that is of new and novel design, of rugged and durable nature, of simple and economic manufacture and otherwise well adapted to the uses and purposes for which it is intended.

Other and further objects of our invention will appear from the following specification and accompanying drawings which form a part hereof. In carrying out the objects of our invention, however, it is to be remembered that its accidental features are susceptible of change in design and structural arrangement, with only preferred and practical embodiment of the best known mode being specified and illustrated in the accompanying drawings, as is required.

BRIEF DESCRIPTION OF DRAWINGS

In the accompanying drawings which form a part hereof and wherein like numbers of reference refer to similar parts throughout:

FIG. 5 is an orthographic side view of a boot having somewhat vertically orientated single pockets on each side of the carrying stays, having snap fasteners.

FIG. 6 is an elongate cross-sectional view through the pocket and stiffener of FIG. 5, taken on the line 6—6 thereon in the direction indicated by the arrows.

DESCRIPTION OF THE PREFERRED EMBODIMENT

Figure 3:
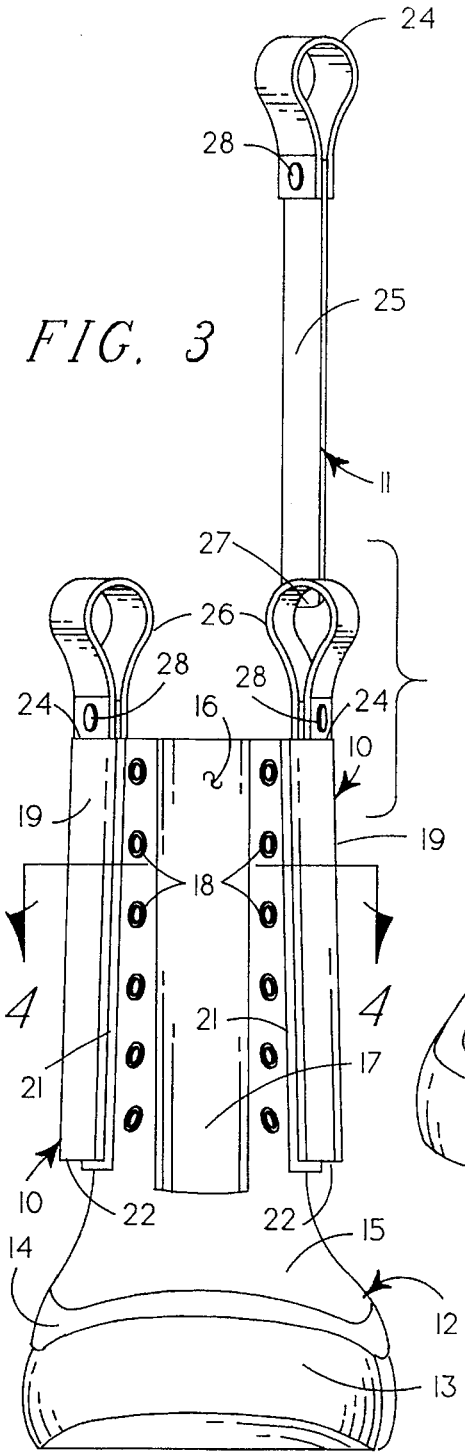
FIG. 3 is an orthographic front elevational view of the boot of FIG. 1.

Our invention generally provides pockets 10, supported on the upper portion of snowboard boot 12, to carry stiffening stays 11 in selectively adjustable positions therein.

Snowboard boot 12 on which our invention is used is a boot of ordinary traditional configuration and nature presently used in the snowboarding arts and may comprise a pre-manufactured boot or one created especially for use with our invention. The boot provides foot 13 with welt 14 interconnecting the sole structure with boot upper portion 15 having traditional front opening 16 covered by tongue 17 and closable by fastener structure 18 in the instance illustrated comprising eyelets interconnected by a lace. The boot may be formed by most of the known manufacturing methods to a traditional snowboard boot configuration that is adaptable to fastening in the common and somewhat standardized boot bindings carried by snowboards. Commonly in the present day, the outer surfaces of sole 13 and welt 14 will be formed of rubber, TEFLON or some polymeric rubber-like material that may be fastened to adjacent elements by traditional mechanical fastening of sewing, adhesion, thermal welding or the like and may also be vulcanized or otherwise joined to the adjacent material to aid in providing a water-proof structure for the boot foot structure, including the sole and welt.

The boot upper portion 15 is formed of some flexible material, commonly a more pliable leather, a woven fabric material such as polymeric canvas, polymeric sheet material or some layered combination of such materials. The pliability of this material varies somewhat, but all such material generally is of a reasonably flexible nature to allow somewhat of a conformable fit about the lower leg of a boot wearer and to allow the leg to have a limited range of motion at the ankle joint relative to the foot of a user. Our invention is adapted for use with such a boot.

Pockets 10 provide body 19 that, when positioned on boot upper 15, defines elongate channel 20 between the body and adjacent boot surface to hold a stiffening stay. Pocket body 19 is an elongate element that is fastened about its similar longer sides 21 and bottom 22 to a surface of boot upper 15 by some mechanical means, in the instance illustrated comprising sewing 23. This fastening also may be accomplished by adhesion, welding or other known methods, depending upon the nature of the materials being joined, and such methods are within the ambit and scope of our invention. The pockets may even be defined within and as a part of the structure of the boot upper itself (not shown), and this also is within the ambit of our invention. The pockets 10 may be defined on the exterior or interior surface of the boot uppers. The top edge of pocket body 19 is not fastened to the supporting boot so as to leave a top opening for channel 20 through which stiffening stays may be inserted.

Figure 1:
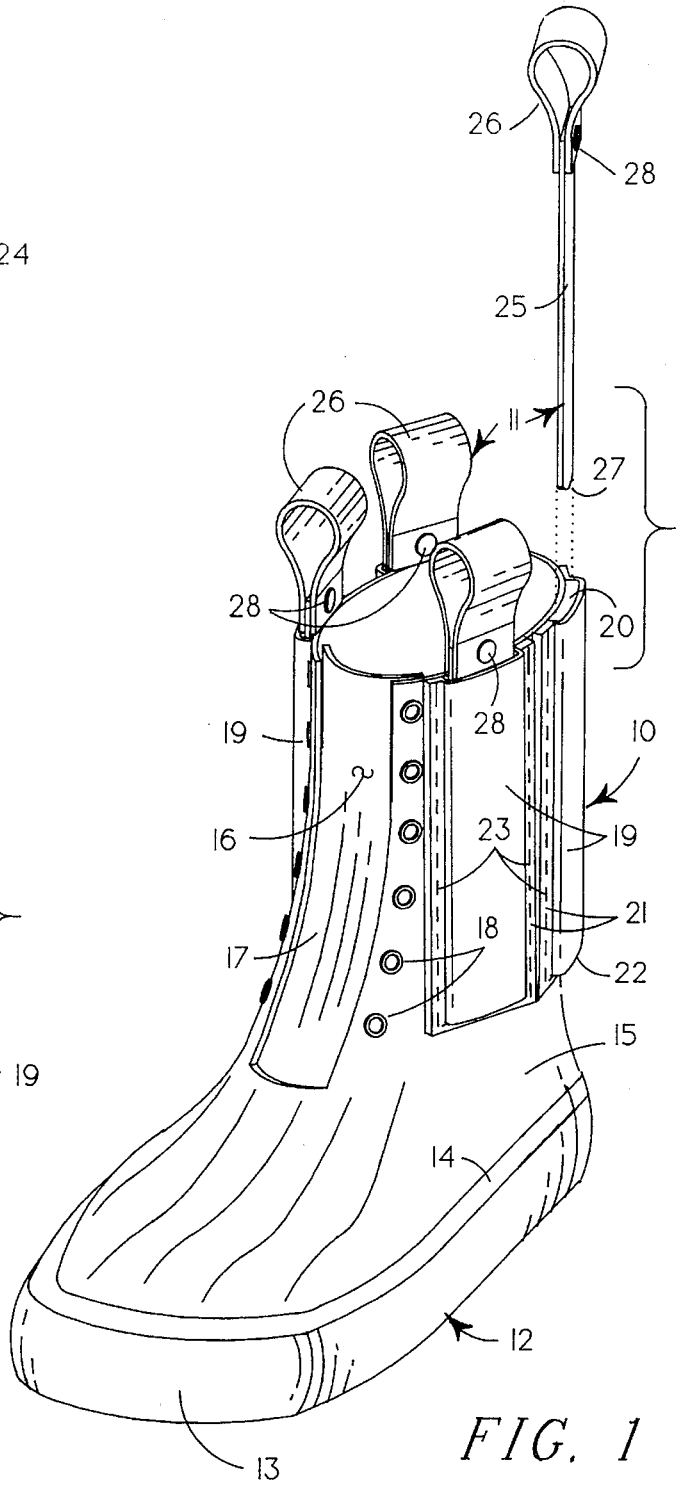
FIG. 1 is a somewhat expanded, isometric surface view of a snowboarding boot having our stiffening structure thereon to show its various parts, their configuration and relationship.
Figures 2, 4:
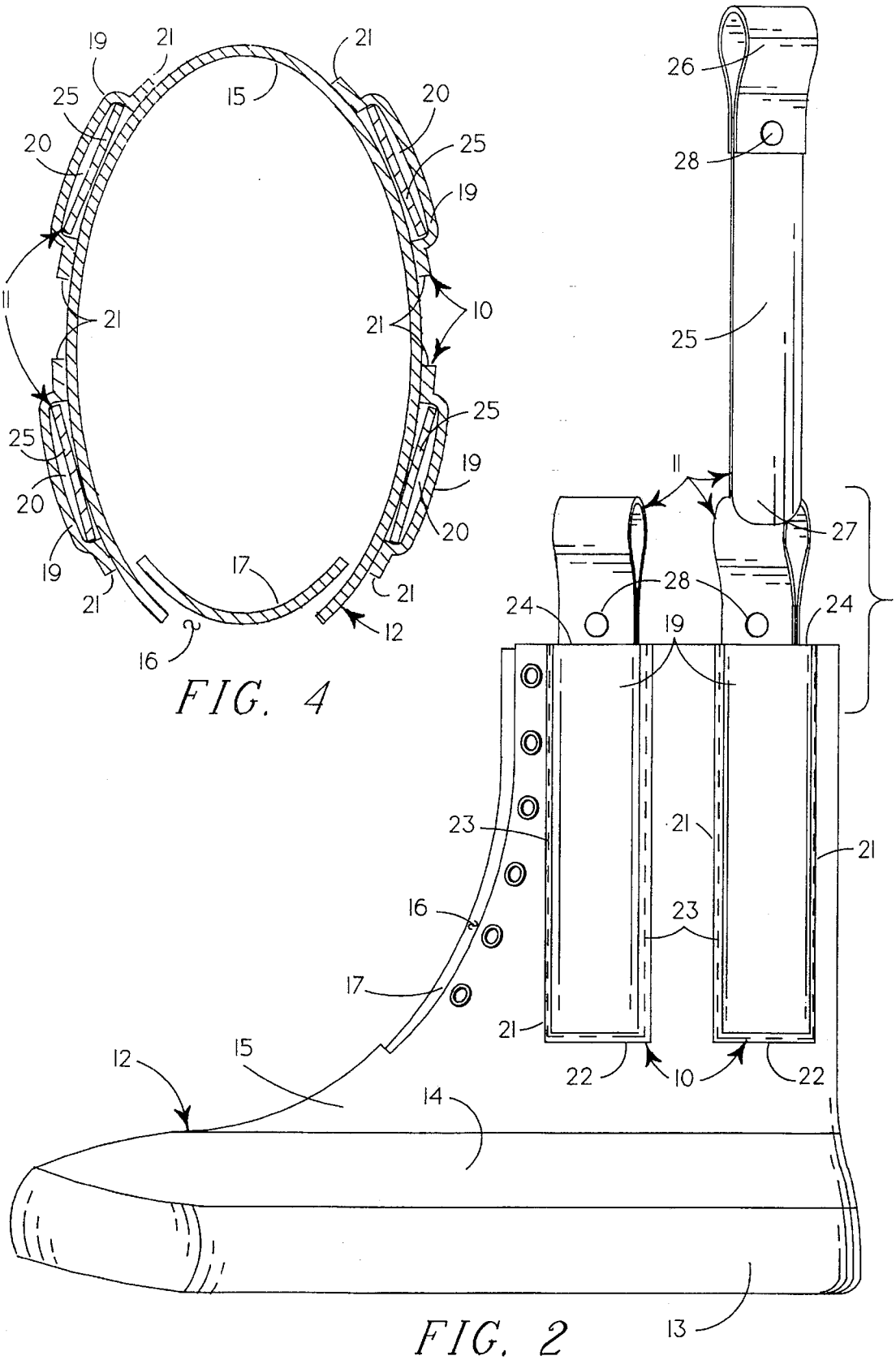
FIG. 2 is an orthographic side elevational view of the boot of FIG. 1, taken from the right side of FIG. 1.
FIG. 4 is a somewhat enlarged, horizontal cross-sectional view through the upper portion of the boot of FIG. 3, taken on the line 4—4 thereon in the direction indicated by the arrows.

The pockets are arrayed in a somewhat vertical orientation extending from the top of upper portion 15 of a snowboard boot downwardly to a position at approximately the ankle of a user. The pockets may be vertical as in FIGS. 1–4 or may be vertically angulated as in FIG. 5, which may allow the use of less stays than the vertical orientation. Preferably pockets are defined on each lateral outside surface of boot upper 15, in a spaced relationship as illustrated in FIG. 1 if there be more than one pocket on a side. Commonly one or two pockets on each side of the boot upper are sufficient to accomplish the purposes of our invention, especially if the stays have appropriate width, and additional pockets are not necessary, though they may be used if desired, especially with narrower stays. Pockets may be placed at the rearward and forward surfaces of the boot, if desired, to make these areas stiffer, though commonly this is not desirable to aid ordinary snowboarding functions. The forward-rearward or width dimensions of each channel 20 preferably are substantially the same and such that when taken into account with the area of the channel, a stiffening stay that is to be used therein will be easily insertable but maintained in position by some frictional force to allow selective positioning and positional maintenance of the stiffening stay once positioned.

In the species of pocket shown in FIG. 5, for a stay not having a manipulation loop, a finger notch 29 is defined in the upper medial portion of the pocket body, and one portion of a releasable snap fastener 30*a* is carried by the boot upper in a position to cooperate with the other snap fastener portion carried by a stiffening stay.

The material from which pocket body 19 is formed preferably has a flexibility similar to or less than that of the material from which boot upper 15 is formed and commonly may be of the same type of material, such as a softer pliable leather, woven fabric canvas, polymeric sheet material or a combination of these materials. A stiffer material may be used for our pockets to enhance the stiffening effect of our invention but, if such material is used, it is to be remembered that the stiffness created by it may not be changed or modified and this detracts from the amount of variation obtainable by use of our stays if the pocket material is of the same or greater flexibility than the material of the boot upper. The same situation may exist in the method of fastening the pocket bodies to the boot uppers, and again normally as great a flexibility as is possible is desirable to create the widest range of potential adjustable stiffening.

Stiffening stay 11 provides stay body 25, in the species of FIGS. 1–4 supporting manipulation loop 26 at its upper end. The stay body 25 is a relatively thin, elongate element of a size and cross-sectional shape to fit and be insertable with position maintaining friction within channel 20 defined by a pocket 10. The lower portion 27 of the stay body is somewhat rounded at its corners to aid placement and insertion within a pocket channel. In this species the manipulation loop 26 is an elongate strip of somewhat resilient material folded upon itself so that each of its ends lie adjacent to the opposite sides of the upper portion of stay body 25, and the loop material is fastened in this position by rivet 28, though other equivalent manipulation aiding devices and fastening means are within the scope of our invention. The length of the stay body from its lower end to the lower edge of manipulation loop 26 is preferably substantially equal to the vertical length of channel 20 defined by pockets 10.

In the species of stiffening stay of FIGS. 5–6 there is no manipulation loop, as its use is optional and the device is fully operative without it. This species also provides one-half 30*b* of snap fastener 30 appropriately positioned to cooperate with the other half 30*a* carried by the boot upper to releasably fasten the stiffening stay within channel 20 of pocket 19. This snap fastener also is optional and our apparatus is operative without the fastener.

The material from which the stiffening stays are formed should be stiffer than the material from which the upper portion 15 of boot 12 is formed and may vary through a wide range of stiffness to the point of substantial rigidity, depending upon the particular results desired from the element. The material also must provide sufficient strength and durability to avoid breakage during use and in the normal adverse environments of that use, and must have sufficient elastic resilience or plastic memory to substantially maintain its original configuration after deformation. The material of preference for stays of greater stiffness is elastically resilient spring steel and for various lesser degrees of stiffness varying through a fairly wide range, the preferred material is one of the higher density polymeric or resinous plastics which may be chosen and styled for a wide range of variance in flexibility especially by varying cross-sectional area and dimension. It is possible that various stiffening stays having different flexibility and elasticity may be used simultaneously in a single boot or in boots for both feet and if the stay bodies are appropriately configured, it is possible that more than one stiffening stay may be used in a single pocket to accomplish a particular desired result.

Having described our invention, its use may be understood.

Firstly, a pair of snowboard boots, or a single boot if desired, are created according to the foregoing specification to embody our adjustable stiffening structure. The boots preferably have pockets 10 extending downwardly on the outer surface of each lateral side of the upper portion 15 of each boot. These boots are placed upon the feet of a user and fastened in normal fashion. The boots may be used in this form, like any other flexible snowboarding boot, for walking and the like and may be used for snowboarding if a boot with a flexible upper is desired for the particular snowboarding use.

If it be desired to stiffen the upper portions of the boots for a particular snowboarding purpose, such as general downhill transport or racing, one or more stiffening stays are placed in the pockets carried on the boot upper. These stays may be placed before a boot is fastened in a snowboard boot harness or after such fastening as desired. For placement the stay is manually moved to a position immediately above the upper orifice of channel 20 and the lower portion of the stiffening stay is inserted within that orifice. The stay during this procedure commonly will be grasped and supported by its upper portion or manipulation loop 26 if present. After establishment of the stiffening stay within channel 20, the stay is moved downwardly by sliding within that channel to a depth that gives the degree and areal positioning of stiffness desired by the user for a particular use. This stiffness may be estimated for stay positioning by the user's motion of his foot to test the stiffness during stay insertion and by experience from prior use. The stays after initial placement may also be adjusted as desired, even during use while snowboarding, so long as they may be accessed.

For normal use the stays selected preferably are such that when they are fully included within the pockets, they create substantially the desired degree of stiffness for downhill snowboarding. When it is desired to change the stiffness of the boot for different snowboarding purposes or to allow walking, the stays may be removed partially or completely merely by pulling them upwardly in the pocket channels or completely out of those channels as the case may be.

It is to be noted that to create various specialized conditions only part of the stays that may be insertable in a particular boot may be used, and stays of varying degrees of stiffness may be used, either individually or in combination. It is also to be noted that multiple stays may be used in a single pocket if either the stays, pocket or both are designed for such purpose to allow insertion and positional maintenance. Various numbers and positioning of pockets on a boot will also create variable parameters to determine the total stiffening effect and its area of application.

The foregoing description of our invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described our invention, what we desire to protect by Letters Patent, and

What we claim is:

1. An adjustably stiffenable boot for snow sports, comprising in combination:

a boot having a foot portion interconnected by an ankle portion with a flexible upper portion extending above the ankle portion and having an uppermost part, opposed lateral outer surfaces and means for opening and fastening upon a foot of a user;

at least one elongate pocket carried by the flexible upper portion of the boot to extend spacedly downwardly from the uppermost part of the flexible upper portion to define an open top channel to receive a stiffening stay: and at least one elongate stiffening stay having less flexibility than the boot flexible upper portion, substantially uniform rectilinear cross-sectional configuration and a rounded first end portion, and a second end portion carrying strap means to aid manipulation, insertion and removal from a pocket, said stiffening stay being slidable in the channel defined by the pocket and maintainable in selected position in the channel by frictional engagement with the surfaces defining the channel.

* * * * *